US009533812B2

(12) United States Patent
Broedsgaard et al.

(10) Patent No.: US 9,533,812 B2
(45) Date of Patent: Jan. 3, 2017

(54) CHILDPROOF BLISTER PACKAGE WITH CONTROLLED OPENING

(71) Applicant: Danapak Flexibles A/S, Slagelse (DK)

(72) Inventors: Ole Broedsgaard, Svendborg (DK); Peter Johansen, Odense C (DK); Else Dydensborg, Odense S (DK); Sanne Norup Westad, Slagelse (DK); Lars Christian Christensen, Slagelse (DK)

(73) Assignee: DANAPAK FLEXIBLES A/S, Slagelse (DK)

( * ) Notice: Subject to any disclaimer, the term of this patent is extended or adjusted under 35 U.S.C. 154(b) by 0 days.

(21) Appl. No.: 14/762,986

(22) PCT Filed: Jan. 23, 2014

(86) PCT No.: PCT/DK2014/000006
§ 371 (c)(1),
(2) Date: Jul. 23, 2015

(87) PCT Pub. No.: WO2014/114297
PCT Pub. Date: Jul. 31, 2014

(65) Prior Publication Data

US 2015/0368018 A1 Dec. 24, 2015

(30) Foreign Application Priority Data

Jan. 24, 2013 (DK) ..... 2013 00045

(51) Int. Cl.
*B65D 75/36* (2006.01)
*B65B 51/24* (2006.01)
(Continued)

(52) U.S. Cl.
CPC ..... *B65D 75/367* (2013.01); *B65B 51/24* (2013.01); *B65D 65/42* (2013.01); *B65D 75/327* (2013.01);
(Continued)

(58) Field of Classification Search
CPC ..... B65D 75/367; B65D 51/24; B65D 75/327; B65D 65/42; B65D 75/527; B65D 2215/04
(Continued)

(56) References Cited

U.S. PATENT DOCUMENTS 3,941,248 A * 3/1976 Moser ..... B65D 75/327 206/484
5,325,968 A * 7/1994 Sowden ..... A61J 1/035 206/532
(Continued)

FOREIGN PATENT DOCUMENTS

DE 3919279 A1 12/1990
DE 202004008975 U1 8/2004
(Continued)

OTHER PUBLICATIONS

ISA/EP, International Search Report, Int'l Application No. PCT/DK2014/000006, May 20, 2015, European Patent Office, Rijswijk, NL, 4 pgs.

*Primary Examiner* — Chun Cheung
(74) *Attorney, Agent, or Firm* — Holland & Hart, LLP

(57) ABSTRACT

The present invention relates to a blister package consisting of a lower web in which a row of cavities is provided, and an upper web which is welded to the provided lower web, and wherein perforation lines are provided between adjoining cavities, and wherein there is an area in connection with each cavity where the upper web is not welded to the lower web, such that a snip is created, said upper web being welded to the lower web by a first inner weld which surrounds the cavity completely, as well as a second outer weld which surrounds the cavity around the first weld and adjoins the area where the upper web is not welded to the lower web. The invention also relates to a method of making the blister package.

19 Claims, 1 Drawing Sheet

(51) Int. Cl.
*B65D 75/52* (2006.01)
*B65D 65/42* (2006.01)
*B65D 75/32* (2006.01)

(52) U.S. Cl.
CPC ..... *B65D 75/527* (2013.01); *B65D 2215/04* (2013.01)

(58) Field of Classification Search
USPC ..... 206/461, 528–532, 534.1, 535
See application file for complete search history.

(56) References Cited

U.S. PATENT DOCUMENTS

| | | | | | |
|---|---|---|---|---|---|
| 5,775,505 | A * | 7/1998 | Vasquez | B65D 75/327 | 206/532 |
| 6,155,423 | A * | 12/2000 | Katzner | B65D 75/327 | 206/469 |
| 7,007,769 | B2 * | 3/2006 | Hara | B62D 5/003 | 180/402 |
| 7,866,475 | B2 * | 1/2011 | Doskoczynski | B65D 75/366 | 206/528 |
| 8,899,419 | B2 * | 12/2014 | Limback | B65D 73/0028 | 206/469 |
| 2005/0269236 | A1 * | 12/2005 | Rohrmus | B65D 75/327 | 206/531 |
| 2008/0308445 | A1 | 12/2008 | Dolak | | |

FOREIGN PATENT DOCUMENTS

| | | | |
|---|---|---|---|
| GB | 1450905 | A | 9/1976 |
| WO | WO-9843893 | A1 | 10/1998 |

* cited by examiner

CHILDPROOF BLISTER PACKAGE WITH CONTROLLED OPENING

CROSS REFERENCES

The present Application for Patent is a 371 national phase of International Application No. PCT/DK2014/00006, entitled "A Childproof Blister Package With Controlled Opening," filed 23 Jan. 2014; and which claims priority to DK Patent Application No. PA 2013 00045, entitled "Bornesikret Blisterpakning Med Styret Abning," filed 24 Jan. 2013; each of which is expressly incorporated by reference herein.

FIELD OF THE INVENTION

The present invention relates to a blister package consisting of a lower web in which a plurality of cavities is provided, and an upper web which is welded to the provided lower web, and wherein perforation lines are provided between adjoining cavities, and wherein there is an area in connection with each cavity where the upper web is not welded to the lower web, such that a snip is created.

BACKGROUND

Blister packages consist of a lower web of a relatively thick material, which is configured such that cavities are created, and an upper web which is welded to the configured lower web, after a product has been filled into the cavities.

The lower web is frequently of PVC (polyvinyl chloride), but now and then also of APET (amorph polyester) or PP (polypropylene), and sometimes also with a layer of aluminium foil laminated to the polymer material—if the barrier requirements are very high.

Today, a relatively hard aluminium foil e.g. in 20μ is provided on most upper webs, through which the product (pill, chewing gum, etc.) may be pressed, but it cannot readily be approved as being childproof.

There are also types with pure aluminium which can be approved as a childproof blister package. Typically, these blister packages may be opened by making an area where the upper web forms a flap.

The childproofness is provided by using a somewhat tougher and optionally thicker aluminium foil which cannot be penetrated, or only with difficulty, it being instead necessary to peel or pull off the upper web. The childproofness is then that a preform of the lower web is made on a sheet, centrally between four cavities, where the upper web is not welded, and through which a perforation line extends. This means that a small snip is created which may be pulled when the upper web is to be peeled off the lower web in order to open a cavity.

Such a known blister package is described e.g. in German Utility Model DE 202004008975 U1 , which discloses a blister package with a lower web in which two rows of cavities are provided, and an upper web which is welded to the lower web. The blister package has perforation lines between adjoining cavities, which makes it possible to tear off one or more cavities from the blister package. The upper web and the lower web are not welded to each other in areas at the intersections of the perforation lines, thereby creating a snip which may be pulled in order to open the cavity.

SUMMARY

The object of the invention is to provide an alternative blister package which can be approved as being childproof (both according to the DIN standard and the ASTM standard), and which, in spite of the childproofness, allows easy opening, e.g. for rheumatic individuals.

Thus, the present invention relates to a blister package consisting of a lower web in which a row of cavities is provided, and an upper web which is welded to the provided lower web, and wherein perforation lines are provided between adjoining cavities, and wherein there is an area in connection with each cavity where the upper web is not welded to the lower web, such that a snip is created. The upper web is welded to the lower web by a first inner weld which surrounds the cavity completely, as well as a second outer weld which surrounds the cavity at least partly around the first weld and adjoins or terminates at the area where the upper web is not welded to the lower web.

According to the invention, a two-part weld is made around each cavity (around each object), an inner full weld being made closest to the cavity, surrounding the cavity completely. In addition, an outer weld is added around the inner full weld, which essentially follows the full weld, but which is not full-welded around the opening corner, which is part of the area where the upper web is not welded to the lower web. The perforation is made through the rim weld between two cavities. The cavities are the compartments in the blister package in which the products, e.g. tablets or chewing gum to be packaged, are arranged.

The upper web is welded to the lower web by generally known techniques and using known types of welding lacquer or polymer coatings which peel against the lower web.

In an embodiment of the blister package, it comprises two rows of cavities.

The two rows may e.g. have 4, 5 or 6 cavities each, so that the blister package may contain 8, 10 or 12 objects, respectively. A blister package in such a size is easy to handle and carry in e.g. a pocket or a bag.

It is preferred that the areas which are not welded to the lower web, are present between four cavities. In this manner, the non-welded area is utilized best, since it may be used for the opening of 4 cavities, and the childproofness is improved since the opening corner is not accessible from the edge of the package.

In order to make it possible to divide the blister package into small parts, it is preferred that the areas which are not welded to the lower web, are separated by perforation lines.

To achieve an even better childproofing of the blister package according to the invention, embodiments are also disclosed in which there is an at least partial weld along an edge of the area which is not welded to the lower web, said edge facing toward the cavity. Hereby, a small additional weld has to be broken when the upper web is pulled or peeled off the cavity.

In the blister packages, materials for the upper web are preferably selected from PVC, PET, APET, PP, PE coated aluminium or PE coated APET. These are materials having a strength so great that they cannot readily be penetrated.

In order to allow adjustment of the force required to pull the upper web off the lower web, the width of the welds may be adjusted. Therefore, the blister package according to the invention also comprises embodiments in which the width of the first inner weld is variable and/or the width of the second outer weld is variable. Basically, the wider the welds, the greater the forces required to pull or peel off the upper web from the lower web.

Since a blister package according to the invention thus provides the possibility of varying the width of the welds, the blister package comprises embodiments in which the first inner weld has a width between 0.05 mm and 5 mm, preferably between 0.1 mm and 3 mm, and/or in which the second outer weld has a width between 0.05 mm and 5 mm, preferably between 0.1 and 3 mm.

Moreover, the invention relates to a method of making a blister package. The method comprises:

providing a lower web configured with cavities;

providing an upper web;

bringing the upper web into contact with the lower web;

attaching the upper web to the lower web by first welds which, in the form of rims, surround the cavities completely;

making additional secondary welds which, in the form of rims, surround the first welds; said secondary welds being terminated at and adjoining the areas where the upper web is welded to the lower web.

The method provides two essentially rim-shaped welds around each cavity. The first weld, which is arranged closest to the cavity, extends all the way around the cavity and seals it. The secondary weld extends around the first weld, but does not necessarily surround it completely, as it adjoins an area where the upper weld is not welded to the lower web. The first weld and the secondary weld may be made at the same time in the method. Alternatively, it is possible to perform the welds so that the first weld is made first, following which the secondary weld is made, or vice versa. Generally, the welds will be made at the same time, however, since this is most expedient in terms of production.

The area where the upper weld is not welded to the lower web, is also the area where tear-off snips are provided for tearing off the upper web from the cavities. It is preferred that this area is traversed by perforations in order to create tear-off snips to adjacent cavities.

Therefore, the method according to the invention preferably also comprises the additional step of providing perforations between the cavities. The perforations may also make it easier to tear individual cavities free from the blister package.

Further, the method makes it possible to adjust the force by which a snip is to be pulled in order to pull the upper web off the lower web and open the cavity. This is done by changing the width or the rim width of the welds. The first welds are preferably welded with rim widths between 0.05 mm and 5 mm, and in particular between 0.1 mm and 3 mm. The secondary welds are welded with rim widths between 0.05 mm and 5 mm, preferably between 0.1 mm and 3 mm.

In order to achieve the best possible childproofness, the method according to the invention also comprises embodiments in which the secondary welds are welded so as to extend right out to the edge of the blister package and right out to the perforations in the areas where the secondary weld is welded to the lower web. These embodiments ensure that, along the edge of the blister package and at the perforations, there are no areas where the upper web is loose and gives rise to a small unwelded edge which with the package may be opened without breaking the perforations.

The part of the secondary welds which is traversed by the perforations, may optionally be welded as a weld in double width, which is subsequently divided into two by perforations. This ensures in a simple manner that the secondary weld extends right out to the perforation, and an unwelded edge is avoided when the perforation is broken.

According to the invention, a film-based upper web may be used, with or without a barrier, and optionally in a transparent variant the material itself being the same optionally with an incorporated barrier which may be used for weldable lids (wafers).

According to the invention, a two-part weld is made around each individual cavity (around each object), with an inner full weld and outer weld which essentially follows the rim of the package, but which is not full-welded around the opening corner, where the tear-off snip is created by not welding the upper web material to the lower web. The perforation is made through the rim weld between two cavities. The cavities are the compartments in the blister package where the products, e.g. tablets or chewing gum to be packaged, are arranged.

Thereby, the following advantages are obtained:

1. The opening force may be determined by adjusting the area which is welded. Larger area=greater peel force. In other words, the opening force may be adjusted by adjusting the width of the welds.
2. Allows the outer weld to be pulled further backwards, thereby allowing a larger opening corner to be made than at a full weld, where the only area which is not welded, is the area where cavities or depressions are provided in the lower web.
3. A more tear resistant product is achieved because of the use of film material, thereby reducing the risk of unintentionally opening an adjacent cavity to the cavity which is to be opened, when a cavity of the blister package is torn.
4. The special double weld minimizes the risk that, in spite of the better tear strength of the film (item 3), a tear nevertheless occurs, then such a tear may be stopped by weld No. 2 , thereby avoiding an opening into the product.
5. Allows a transparent upper web to be made, so that it is visible which product has in reality been packaged.
6. Allows pure film solutions to be made optionally in mono-materials (APET lower web and upper web in pure PET).
7. Allows lamination of an aluminium foil, thereby achieving a barrier at aluminium level, while maintaining the tear and opening properties.
8. Provides a better childproofness, since it is possible to press objects through the upper web in existing aluminium foil solutions, even through the solutions are approved.
9. May be made in variants which may be welded to existing blister lower web materials (PVC, APET, PP as well as PE coated aluminium or PE coated APET).
10. May be used in existing filling lines, since just a minor modification of the welding tool is required.

DETAILED DESCRIPTION

Figure 1:
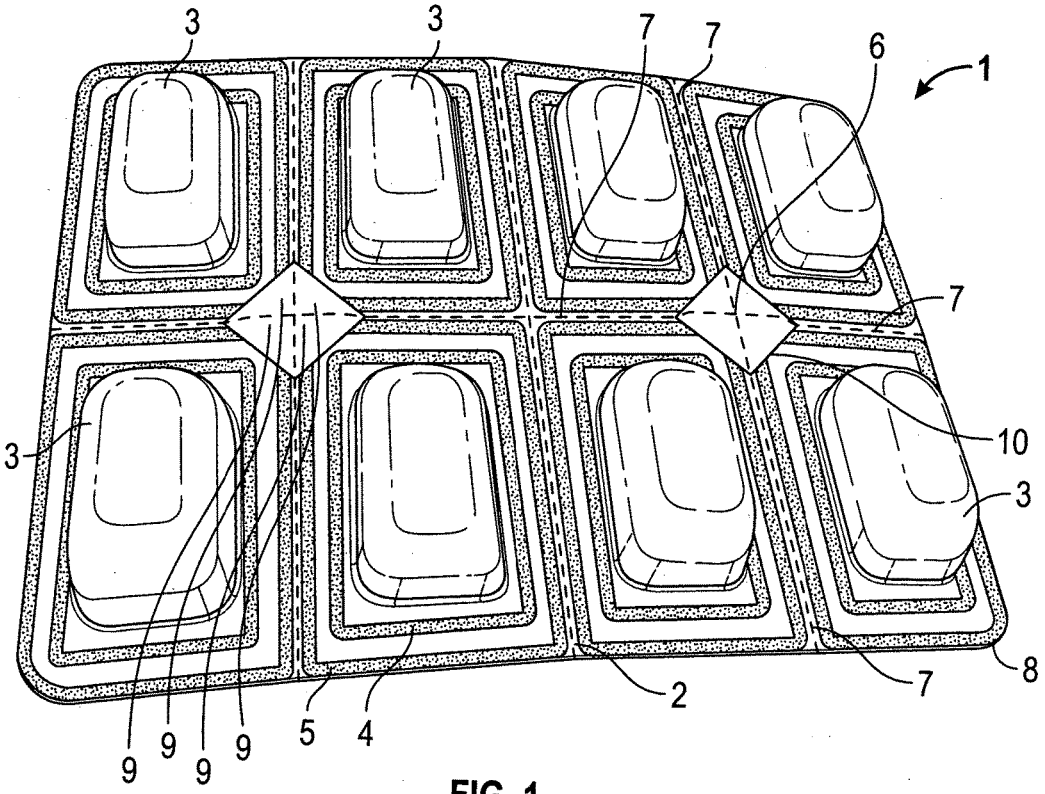
FIG. 1 shows a blister package according to the invention, seen toward the lower web.

FIG. 1 shows a blister package 1 according to the invention, seen toward the lower web 2 with the cavities 3. Around each cavity 3, there is a first weld 4 which extends all the way around the cavity 3, as well as an additional secondary weld 5 which extends around the first weld 4 and adjoins an area 6 where the upper web 12 (not shown in FIG. 1) and the lower web 2 are not welded together.

The blister package 1 is traversed by perforations 7, so that each cavity 3 may be torn off the blister package 1 as an independent unit 8.

The perforations 7 intersect each other in the areas 6 where the upper web is not welded to the lower web, thereby providing, for each of the units 8 with cavities 3, a snip 9 which may be used for tearing off the upper web from the lower web, thereby opening the cavity 3.

In this embodiment, the areas 6 are surrounded by a thin weld 10. However, the weld 10 is not required and may be omitted in other embodiments. In this case, the weld 10 is four-sided, but it may also be circular, oval or have other shapes. Likewise, the welds 4 and 5 may be made with a varying width to change the force to be used in order to tear off the upper web from the lower web.

Figure 2:
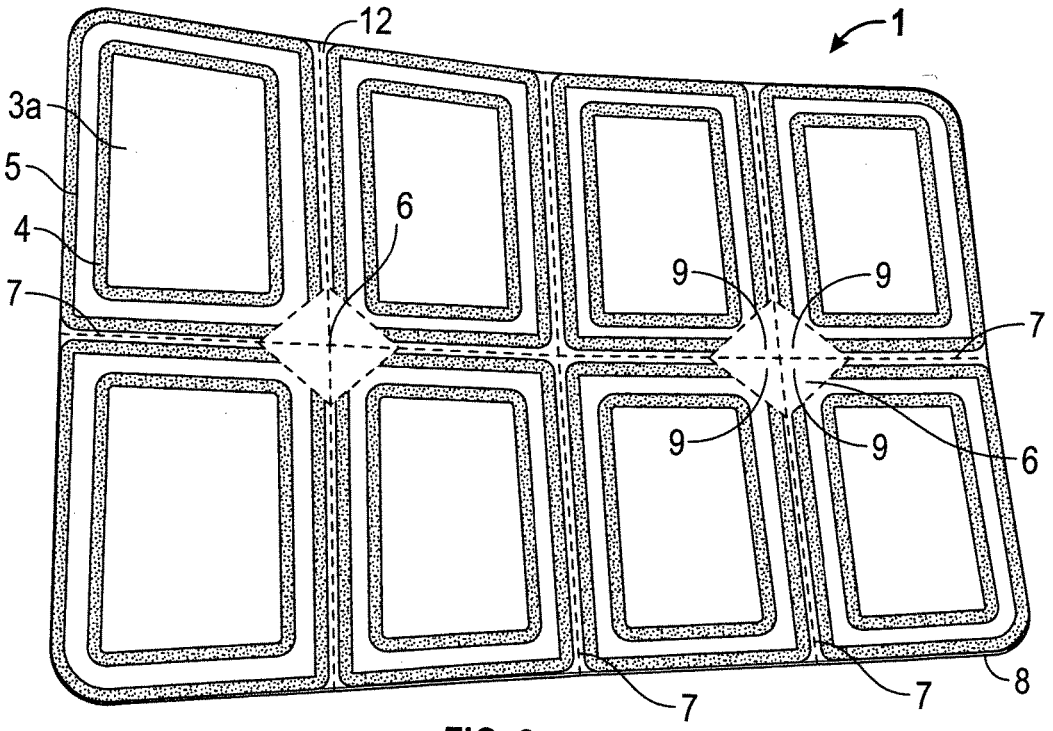
FIG. 2 shows the blister package, seen toward the upper web.

FIG. 2 shows the blister package 1 seen down toward the upper web 12. The figure shows the first weld 4, which completely surrounds the area 3*a* below which the cavity is present. The second secondary weld 5 extends around the first weld 4, adjoining the area 6 where the upper web 12 is not welded to the lower web 2 (not shown in FIG. 2).

The perforations 7 traverse the blister package 1 and intersect each other in the areas 6, so that four snips 9 are provided in each area. Each individual snip may be used for tearing off the upper web from a single cavity 3, each of the cavities being delimited from each other by the perforation lines 7, so that each cavity may be regarded as forming an independent unit 8 from which the upper web may be torn off from the individual cavity. In the embodiment shown, the secondary welds 5 in principle extend along the rim or the edge of the blister package 1 and along the perforations 7. This may involve advantages in terms of production, it being then possible, on large parts of the blister package, to make the secondary weld as a wide weld (in double width), which is then divided into two by the perforation line.

The invention claimed is:

1. A blister package, comprising:

a lower web in which a row of cavities is provided; and;

an upper web which is welded to the provided lower web;

wherein perforation lines are provided between adjoining cavities; and wherein there is an area in connection with each cavity where the upper web is not welded to the lower web, said area forming a snip; and;

wherein the upper web is welded to the lower web by a first, inner weld which surrounds one of the cavities completely, and a second, outer weld which surrounds said one cavity partly around the first, inner weld and terminates at the area where the upper web is not welded to the lower web.

2. The blister package according to claim 1, wherein the blister package comprises two rows of cavities.

3. The blister package according to claim 2, wherein the areas which are not welded to the lower web are disposed between four of the cavities.

4. The blister package according to claim 3, wherein the areas which are not welded to the lower web are separated by the perforation lines.

5. The blister package according to claim 1, wherein an at least partial weld is provided along an edge of the area which is not welded to the lower web, said edge facing toward the cavity.

6. The blister package according to claim 1, wherein materials for the upper web are selected from polyvinyl chloride (PVC), polyethylene terephthalate (PET), amorphous polyethylene terephthalate (APET), polypropylene (PP), polyethylene (PE) coated aluminium or PE coated APET.

7. The blister package according to claim 1 wherein the width of the first, inner weld is variable.

8. The A blister package according to claim 1, wherein the width of the second, outer weld is variable.

9. The blister package according to claim 1, wherein the first, inner weld has a width between 0.05 mm and 5 mm.

10. The blister package according to claim 1, wherein the second, outer weld has a width between 0.05 mm and 5 mm.

11. A method of making a blister package, said method comprising:

providing a lower web configured with cavities;

providing an upper web;

bringing the upper web into contact with the lower web;

attaching the upper web to the lower web by a first weld which, in the form of a rim, surrounds one of the cavities completely;

performing an additional, secondary weld which, in the form of a rim, surrounds said one cavity partly around the first weld, said secondary weld being terminated at an area where the upper web is not welded to the lower web, said area creating a snip.

12. The method according to claim 11, further comprising providing perforations between the cavities.

13. The method according to claim 11, wherein the first weld is welded with a rim width between 0.05 mm and 5 mm.

14. The method according to claim 11, wherein the secondary weld is welded with a rim width between 0.05 mm and 5 mm.

15. The blister package according to claim 1, wherein the first, inner weld has a width between 0.1 mm and 3 mm.

16. The blister package according to claim 1, wherein the second, outer weld has a width between 0.1 mm and 3 mm.

17. The method according to claim 11, wherein the first weld is welded with a rim width between 0.1 mm and 3 mm.

18. The method according to claim 11, wherein the secondary weld is welded with a rim width between 0.1 mm and 3 mm.

19. The method according to claim 12, wherein the secondary weld is welded so as to extend to an edge of the blister package and to the perforations in areas where the secondary weld is welded to the lower web.

* * * * *